United States Patent [19]

Powell

[11] 4,152,835

[45] May 8, 1979

[54] DUAL STEREOGRAPHIC NET

[76] Inventor: Christopher M. Powell, 6 Elizabeth St., Ryde, New South Wales 2113, Australia

[21] Appl. No.: 843,179

[22] Filed: Oct. 18, 1977

[30] Foreign Application Priority Data

Nov. 8, 1976 [AU] Australia ..... PC8050

[51] Int. Cl.[2] ..... B43L 5/00

[52] U.S. Cl. ..... 33/1 SD; 235/61 NV

[58] Field of Search ..... 235/61 NV, 78 N, 88 N; 33/1 SP, 76 V, 1 C, 1 E, 1 N, 78, 1 SB, 1 SA

[56] References Cited

U.S. PATENT DOCUMENTS

| | | | |
|---|---|---|---|
| 2,114,652 | 4/1938 | Dalton | 33/1 SD |
| 2,755,565 | 7/1956 | Alkema | 33/1 SD |
| 2,916,207 | 12/1959 | Vohland | 235/61 NV |
| 3,231,188 | 1/1966 | Warner | 235/61 NV |
| 3,373,493 | 3/1968 | McDonald | 235/61 NV |
| 3,983,630 | 10/1976 | Hamm et al. | 33/1 SD |

*Primary Examiner*—Stephen J. Tomsky

*Attorney, Agent, or Firm*—Ladas, Parry, Von Gehr, Goldsmith & Deschamps

[57] ABSTRACT

Instruments presently available for stereographic calculations use a single net over which transparent paper is moved. The device of this invention has two nets, one printed on each side of a rotatable disc in a frame and the calculations are made by rotating the nets under transparent paper fixed to the frame.

1 Claim, 4 Drawing Figures

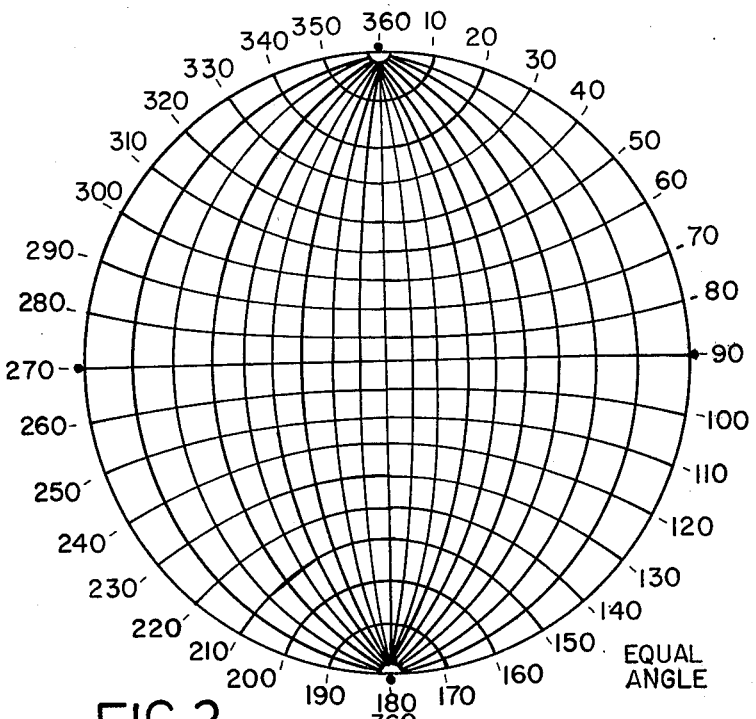
FIG. 2
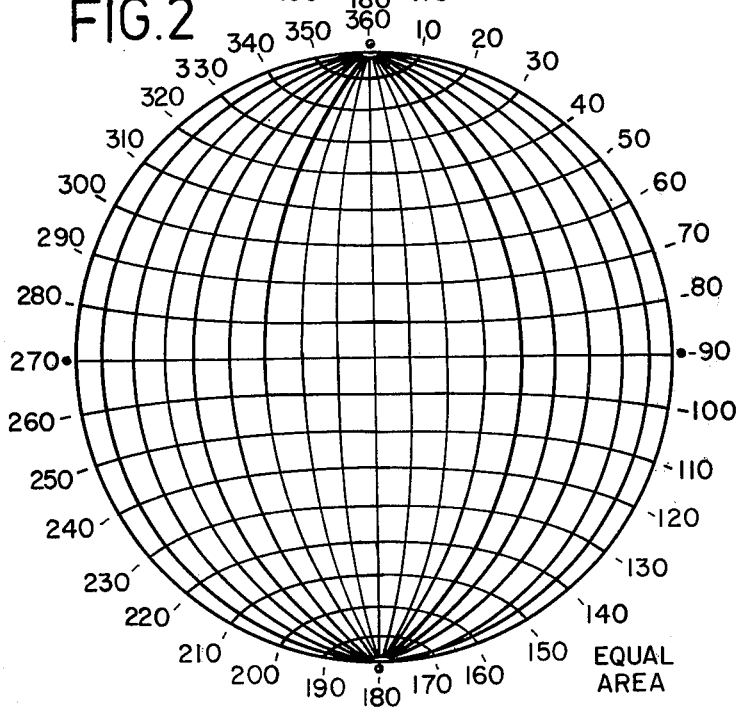

DUAL STEREOGRAPHIC NET

The present invention relates to an instrument for making three-dimensional angular calculations in two dimensions by means of on a circular base which moves with respect to a reference direction. Calculations of the attitudes of planes and lines in space, and of the angular separations between planes, planes and lines, and lines and lines can be made using convention three-dimensional solid geometry, but are made considerably quicker and easier using two-dimensional plots such as the stereographic net. The basic principle of the stereographic net is to represent three dimensions as two, and two dimensions as one.

Stereographic projection has been known for several centuries, and there are many texts describing the uses and calculations which may be made on a stereographic net. The basic principle of the stereographic net is to represent three-dimensional angular relations on two dimensions, thus enabling three-dimensional calculations to be carried out accurately on a planar surface. The sterographic net is thus of use to all people requiring accurate (to±1°) calculations of three-dimensional angular relations. Geologists, architects, carpenters and engineers are amongst those for whom the stereographic net is useful.

The type of problem easily solved using the stereographic projection is best illustrated by considering a simple example: Suppose a planar surface has an attitude such that its strike (i.e. the bearing of a horizontal line in the plane, referred to a compass card numbered 0° to 360° in which 90° is East, 180° South and 270° West) is 120°, and its dip (i.e. the angle of inclination measured perpendicular to the strike) is 60° towards the northeast. A second plane strikes 030° and dips 40° towards the northwest. It is required to determine the angle between the two surfaces, and the direction and attitude of the line of intersection. By solid geometry one could, with considerable care and time, show that the line of intersection of the two planes plunges 37° towards 325°, and the angle between the two planes is 68° (measurements to the nearest degree). With a stereographic net, these calculations can be made within a minute. Many other calculations involving all possible angular relations between lines and planes can be made, and are described in standard texts.

Previous instruments manufactured to carry out stereographic calculations have varied from an inexpensive simple paper-printed net on which a transparent overlay is fixed with a centre pin to heavy, expensive machined metal nets. Both these designs keep the reference net fixed, and rotate the transparent overlay, a procedure which has considerable disadvantage as the relative orientation of the reference direction is continually changing with respect to the operator.

The invention resides in the basic instrument design which includes the specific application for stereographic calculations, and its method of manufacture by injection moulding.

The invention in its broadest form comprises an instrument for making three-dimensional calculations comprising a circular disc rotatable in a frame, the frame comprising two flat surfaces and four sides and being cut-away on at least one side to expose the edge of the disc to enable it to be rotated, the frame also having a cut-away on each of its flat surfaces to expose the central area of each side of the disc, a calculating net on each exposed area of the disc, whereby three-dimensional calculations may be made by fixing transparent paper to the frame and over the net on the disc and rotating the disc.

The invention in one form will now be described with reference to the accompanying drawings in which:

FIG. 2 shows two types of nets that can be used.

Figure 1:
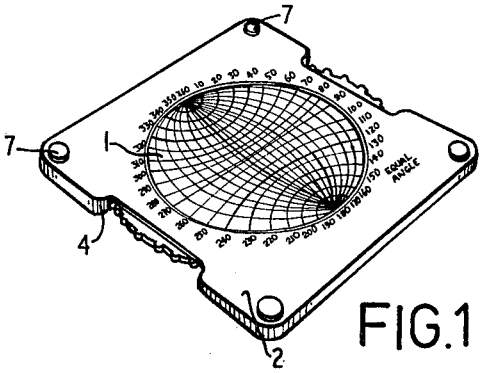
FIG. 1 is a perspective view of the complete instrument

FIG. 1 shows a plan and half section (4—4) of the instrument (at approximately half scale) which may be moulded in a high-quality material (e.g. 30% glass-filled Nylon) that has properties of (i) excellent dimensional stability (ii) high rigidity (iii) very high heat-distortion temperature (iv) resistance to surface abrasion. The simplicity of the design is one of its most important attributes. In one form, the instrument is designed to be manufactured from two injection-moulding dies with two casts from each mould to be solvent-welded together so that the instrument is bilaterally symmetrical.

Figure 4:
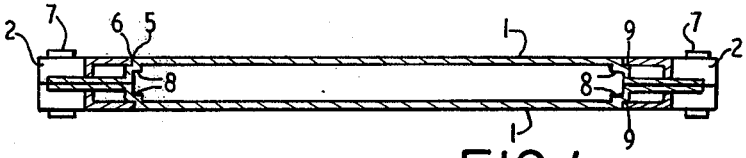
FIG. 4 is a sectional view along the line 4—4 of FIG. 3.
Figure 3:
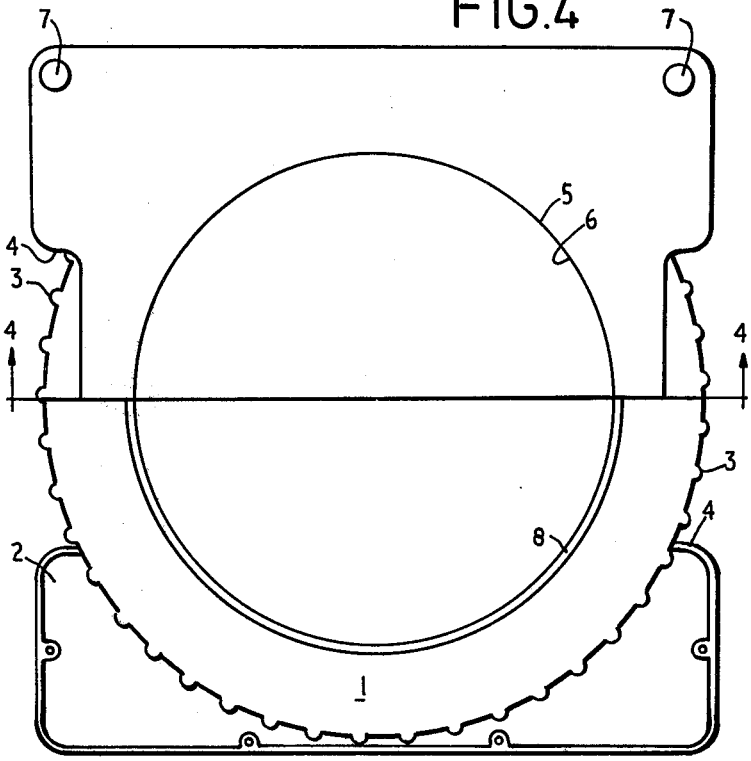
FIG. 3 is a half cut-away plan view of the instrument

The circular disc of which a central circular portion less than the full diameter of the disc is raised with vertical edges 5, fits inside a circular aperture of the same or fractionally larger, diameter against a similar vertical edge 6 in the outer square frame 2. The outside rim 5 of the raised portion of the circular disc 1 thus rests snugly against the inside 6 of a similar aperture in the outer square frame, tight enough to prevent slop in the position of the circular disc, but not so tight as to prevent the circular disc 1 being turned by finger pressure on the moulded grips 3 at the edge thereof which protrude on opposite sides of the square frame 2 in cut-away sections 4. The circular disc 1 is the only moving part in the instrument, and the working bearing in the lateral direction is the outside 5 of the circular disc 1 against the inside 6 of an identical circular aperture moulded in the square frame 2. The working bearing in the vertical direction comprises the circular flanges 8 and the inside 9 of frame 2 around the circular aperture. Four pegs or rubber grummets 7 on each side of the frame project whichever is the underside from abrasion when the instrument is being used on a table or other flat surface. The disc 1 is shown in sectioned form in FIG. 4. The mode of manufacturing the disc is to mould two identical halves which are generally dish-shaped and the two halves are glued together to make a disc of the shape shown in the drawings. Hence what is shown in FIG. 4 is not two discs but one disc made up of two halves.

The particular nets to be printed initially on the disc 1 are illustrated in FIG. 2, one net to be printed on each side of the disc. Other nets or grids for calculation (e.g. Fedorov, polar stereographic and polar equal-area nets) can be printed as required. Degrees are marked round the cut-aways in the frame. Printing may be with a silk screen, finished with a lacquer to increase resistance to abrasion. This bilateral symmetry is one of the most important features of the design as it permits working calculations made on one side of the instrument to be stored on the other side. In addition, calculations performed best on one kind of net, may be transferred to the other net for different calculations The calculations referred to are the determination of any of the angular relations for which a stereographic net can be used. The equal-angle stereographic net is one in which the locus of all lines having a fixed angular separation from a given direction is an arc of a circle, and thus construction of this locus is geometrically simple. The equal-area stereographic net is one in which equal areas on the surface of the globe have equal area in the projection, and is thus useful for statistical treatment of the frequency of given directions.

The locus of all lines having a fixed angular separation from a given direction is, however, an ellipse on the equal-area stereographic projection, and is thus not easily constructed geometrically. All other construction techniques apply to both equal-angle and equal-area nets, although the position of points representing the same orientations inside the outer circular perimeter is different for each net. In practice, it is common to use the equal-angle nets for performing individual calculations of a large set, and to use the equal-area nets for storing, or keeping a progressive plot, of each solution. An example of the combined use of both sides of the disc follows:

The Problem

In a complexly deformed rock body, the axes of minor folds plunge in a number of directions. It is desired to determine the orientation of these folds both on a local and more regional scale.

The Procedure

At each outcrop, the attitude of bedding around each fold is determined from as many surfaces as is necessary to define the fold axis. Each bedding measurement is plotted on the equal-angle side of the net as a pole (i.e. line normal to bedding), and the pole of the great circule containing all the bedding poles defines the fold axis (FIG. 1). (In FIG. 1, the bedding planes with dip/-dip azimuth orientations of 52°/020°, 59°/086°, 076°/114°, 75°/328° and 59°/355° define a fold axis plunging 50° towards 040°). This fold axis is then plotted on the equal-area side of the instrument (FIG. 2), where it is stored with all such similar calculations from other outcrops. The resultant distribution of fold axes can then be analysed, and in the example shown in FIG. 2 defines a great circule which is normal to the regional slaty cleavage. By the use of both sides of the instrument, one side (the equal-angle side) can be kept free for calculations at each outcrop (by erasing the data from previous outcrops), and the progressive, statistical plot for all outcros can be kept on the equal-area side. There is no other instrument in the world which permits such an operation. The calculations are made on a transparent overlay which is fixed with respect to the outer square frame 2. In practice, this is a piece of tracing paper or plastic film which is fixed to the outer square frame with masking tape or other suitable adhesive and pencil or ink marks are made on the overlay as the circular disc 1 (on which the calculating net is printed or fixed) is rotated.

The capability for two different nets to be printed on the one instrument, its light weight and durable properties together with the advantages of the moving nets make the instrument of the invention a major advance.

What I claim is:

1. An instrument for making three-dimensional angular calculations in two dimensions by means of a circular base comprising a circular disc rotatable in a frame, the frame comprising two flat surfaces and four sides and being cut-away on at least one side to expose the edge of the disc to enable it to be rotated, the frame also having a cut-away on each of its flat surfaces to expose the central area of each side of the disc, an equal-angle stereographic net on one exposed central area of the disc, an equal-area stereographic net on the other side exposed central area of the disc, and degrees marked round the cut-away on each of the flat surfaces of the frame, the calculations being made on a transparent overlay fixed to the outside of the frame.

* * * * *